US006328303B1

(12) United States Patent
Maetani

(10) Patent No.: US 6,328,303 B1
(45) Date of Patent: Dec. 11, 2001

(54) IMAGE FORMING APPARATUS WITH BUILT-IN SURFACE REVERSE PATH

(75) Inventor: Masami Maetani, Ageo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/189,721

(22) Filed: Nov. 12, 1998

(30) Foreign Application Priority Data

Nov. 13, 1997 (JP) ..... 9-312061

(51) Int. Cl.[7] ..... B65H 5/06

(52) U.S. Cl. ..... 271/273; 271/186; 271/301; 271/902

(58) Field of Search ..... 271/273, 291, 271/301, 65, 184, 185, 186, 314, 902, 225

(56) References Cited

U.S. PATENT DOCUMENTS

| | | | | |
|---|---|---|---|---|
| 3,883,241 | * | 5/1975 | Zeuthen | 355/3 |
| 4,147,426 | * | 4/1979 | Miyoshi et al. | 271/291 |
| 5,208,640 | * | 5/1993 | Horie et al. | 271/301 |
| 5,708,954 | * | 1/1998 | Ando et al. | 399/402 |
| 6,012,715 | * | 1/2000 | Kasahara | 271/186 |
| 6,129,349 | * | 10/2000 | Olbrich et al. | 271/186 |
| 6,236,824 | * | 5/2001 | Pardubitzki | 399/124 |

FOREIGN PATENT DOCUMENTS

| | | | | |
|---|---|---|---|---|
| 61-119567 | * | 6/1986 | (JP) | B65H/43/04 |
| 62-235136 | * | 10/1987 | (JP) | 209/291 |
| 63-106268 | * | 5/1988 | (JP) | 271/291 |
| 63-196453 | * | 8/1988 | (JP) | 271/186 |
| 62-168033 | * | 1/1989 | (JP) | B65H/5/06 |
| 1-187129 | * | 7/1989 | (JP) | 271/291 |
| 63-135260 | * | 12/1989 | (JP) | 271/301 |
| 40-5208737 | * | 8/1993 | (JP) | 271/273 |
| 40-6127793 | * | 5/1994 | (JP) | 271/301 |
| 40-6156774 | * | 6/1994 | (JP) | 271/273 |
| 40-6183609 | * | 7/1994 | (JP) | 271/186 |
| 5-132184 | * | 5/1998 | (JP) | B65H/5/06 |
| 10-114437 | * | 6/1998 | (JP) | B65H/3/44 |
| 10-147451 | * | 6/1998 | (JP) | B65H/5/06 |

* cited by examiner

*Primary Examiner*—Donald P. Walsh
*Assistant Examiner*—Daniel K Schlak
(74) *Attorney, Agent, or Firm*—Fitzpatrick, Cella, Harper & Scinto

(57) ABSTRACT

There is disclosed a sheet feeding unit, for an image forming apparatus, provided with a sheet stacking means for stacking the sheets for image formation, an external cover surrounding the perimeter of the sheet stacking means, and a substantially vertical reversal path provided at a side of the sheet stacking means and serving for sheet reversing, the unit comprises a slit-shaped aperture provided in the external cover substantially horizontally and an inclined path connecting the slit-shaped aperture and the lower end of the reversal path, whereby the sheet dropping into the reversal path for example by the jammed sheet disposal in the image forming unit is smoothly discharged to the exterior of the unit and is prevented from remaining in the reversal path.

19 Claims, 5 Drawing Sheets

IMAGE FORMING APPARATUS WITH BUILT-IN SURFACE REVERSE PATH

BACKGROUND OF THE INVENTION

1. Field of the Invention

The present invention relates to an image forming apparatus such as a copying apparatus or a printer, and more particularly to an improvement in the image forming apparatus provided with a sheet reversing mechanism.

2. Related Background Art

In the conventional image forming apparatus, as shown in FIG. 6, for forming images on both faces of a sheet such as paper, an image forming unit B in the main body 1 of the apparatus is provided with a reversal path 29 for reversing a sheet feeding direction i.e., front/rear face and a forward-reverse rotation roller 32, while a cassette pedestal (paper feeding unit) C is provided with a reversal path 40. A sheet bearing an image on a side thereof is once fed into the reversal path 29 by the forward rotation of the roller, and then the roller is rotated reversely to introduce the reversed sheet into the image forming unit through a convey path 18 whereby another image is formed on the other side of the sheet. A longer sheet can also be reversed by feeding a part thereof into the reversal path 40 in the cassette pedestal.

In such image forming apparatus, however, if an openable guide member supporting the forward-reverse rotation roller is opened to remove the jammed sheet therein, the sheet drops to the reversal path 40, thus remaining in an blocking the path. In such situation, the ensuing sheet entering the reversal path cannot smoothly enter the reversal path and may eventually be creased to cause jamming trouble.

For avoiding such situation, it has been tried to install a sheet sensor inside the reversal path or to employ an openable cover for removing the remaining sheet, but such measures have resulted in a wider space required, an increase in the cost or an increase in the jam removing process. Also the sheet sensor may be unable to detect the sheet which has been broken and has remained in the apparatus. Particularly in case a finisher F containing multiple sheet discharging trays is installed and if a sheet remains in the sheet reversing unit at a sheet jamming, it is necessary to move the finisher F for making a space for opening a door 30, for the purpose of jam elimination in the sheet reversing unit.

Also, even if the main body is used alone without the multiple sheet discharging trays, the sheet reversal is to be conducted within the apparatus because otherwise the sheet to be reversed appears outside the apparatus and may cause danger to the operator. Therefore, if the sheet drops into the reversal path in a sheet jamming, a wide space is likewise required in order to open one side of the sheet guides for eliminating such dropped sheet.

SUMMARY OF THE INVENTION

In consideration of the foregoing, the object of the present invention is to provide an image forming apparatus enabling sheet reversal without jamming, with a relatively simple structure.

The above-mentioned object can be attained in an image forming apparatus provided with at least a sheet stacking means for stacking sheets for image formation, an external cover surrounding the perimeter of the sheet stacking means, and a substantially vertical sheet reversing path provided at a side of the sheet stacking means, a slit-shaped aperture provided in the external cover in a substantially horizontal direction, and an inclined path connecting the slit-shaped aperture and the lower part of the reversal path are provided.

In such configuration, in case the forward-reverse rotation roller of the image forming apparatus is opened to remove the sheet remaining therein and such sheet drops into the reversing path of the sheet feeding unit, such sheet freely drops from the reversing path through the aperture provided in the external cover of the sheet feeding unit and is discharged therefrom, whereby the sheet will not remain in the reversing path and does not hinder the entry of the ensuing sheet nor damage such ensuing sheet.

DETAILED DESCRIPTION OF THE PREFERRED EMBODIMENTS

Figure 1:
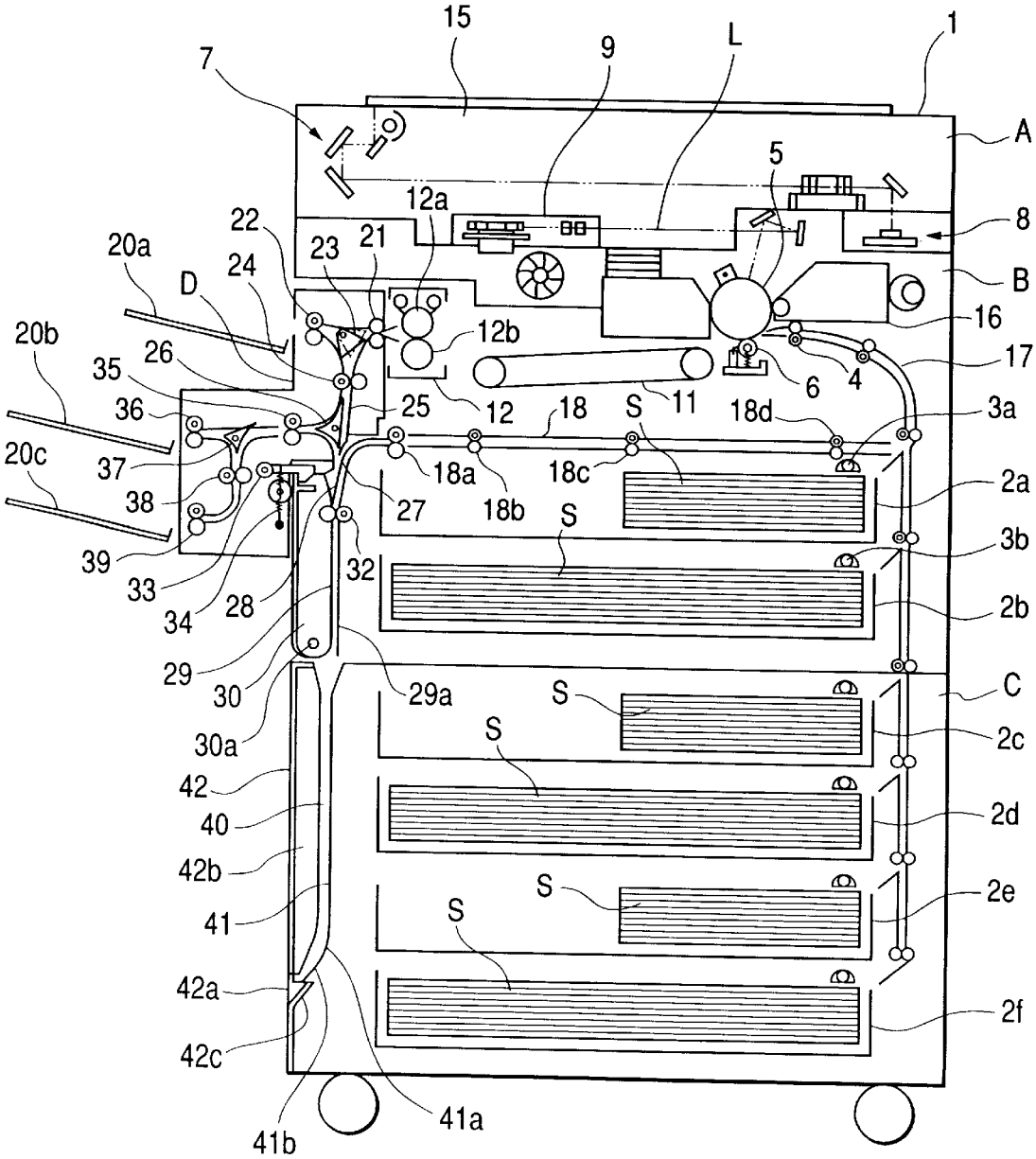
FIG. 1 is a schematic cross-sectional view of a sheet feeding unit constituting a first embodiment of the present invention.
Figure 2:
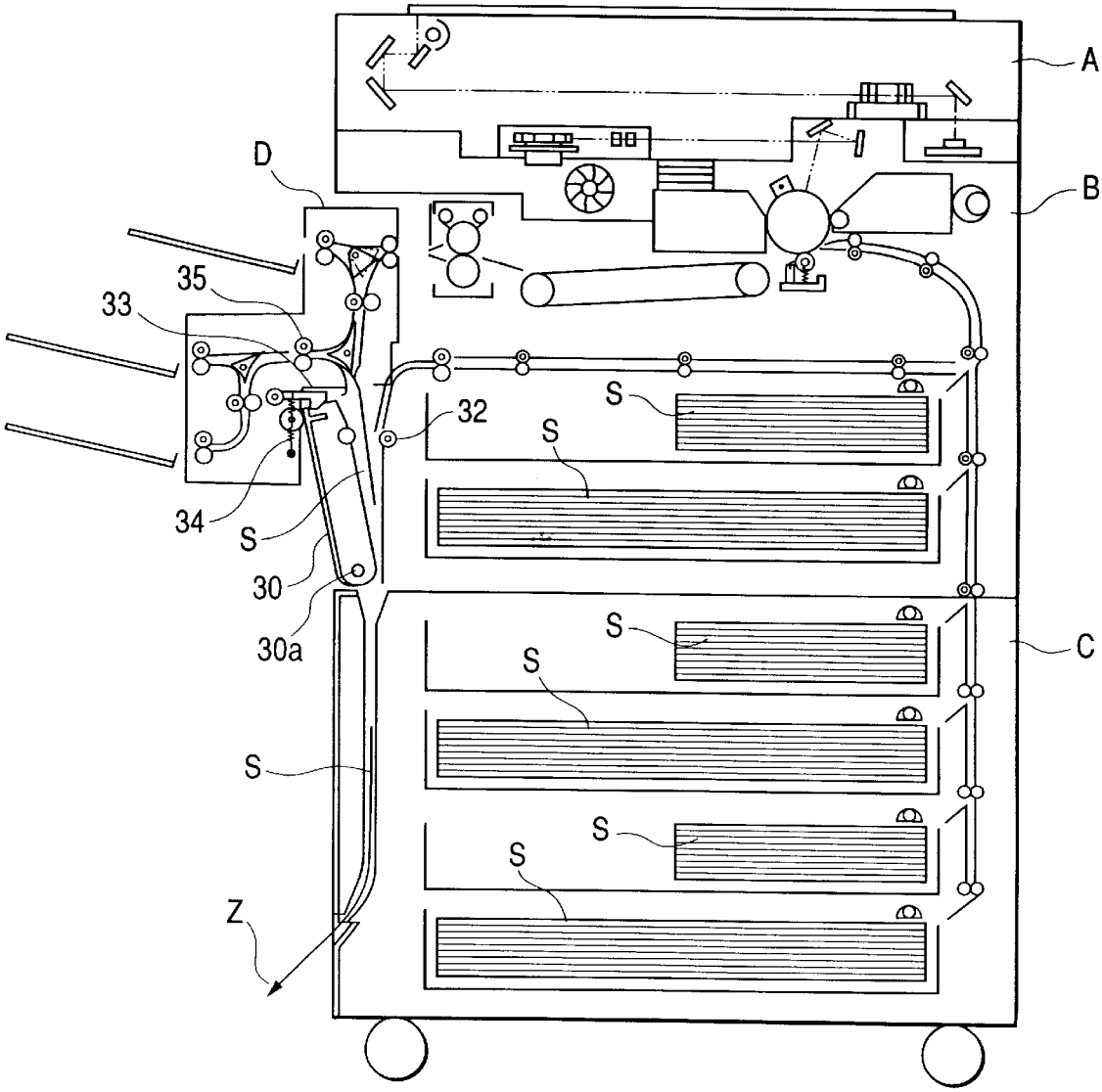
FIG. 2 is a schematic cross-sectional view showing the linkage between the multiple sheet discharging tray unit and an openable guide member in the above-mentioned embodiment.
Figure 3:
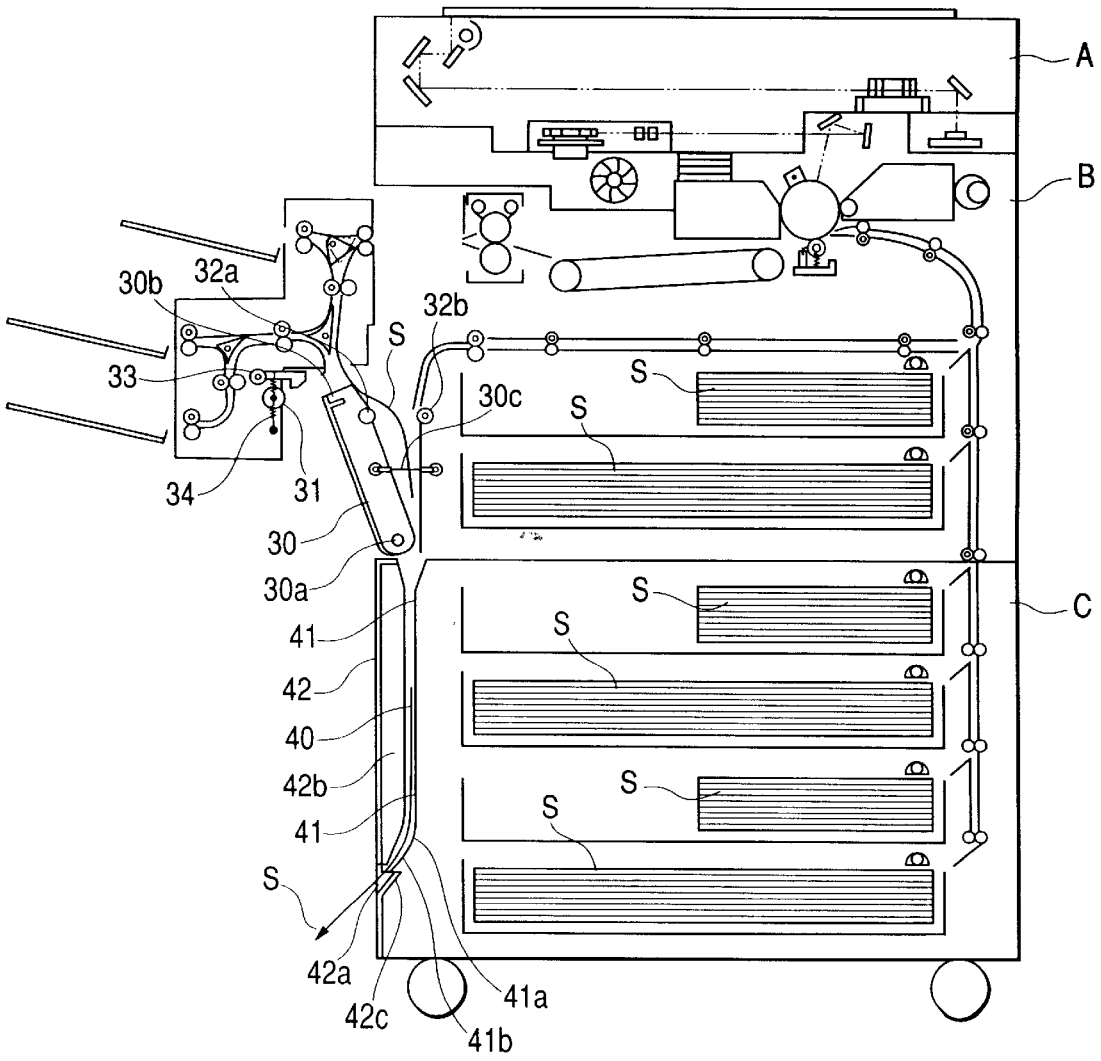
FIG. 3 is a schematic cross-sectional view showing the relationship between the multiple sheet discharging tray unit and the openable guide member in the above-mentioned embodiment.

At first there will be explained, with reference to FIGS. 1 and 2, the entire configuration of an image forming apparatus constituting a first embodiment of the present invention.

In the upper part of the main body 1 of the image forming apparatus there is provided an image reading unit A for reading the image information of an original, and an image forming unit B is provided thereunder for recording an image corresponding to the image information on a sheet S. In the image forming unit B, cassettes (sheet stacking means) 2*a*, 2*b* are provided for housing the sheets S, and the sheet S advanced from either of these cassettes by pickup roller (sheet feeding means) 3*a* or 3*b* is individually separated by sheet separating means (not shown) and is fed through a feed path 17 to the position of an electrophotographic photosensitive drum 5 provided in the image forming unit B and constituting a part of the image forming means.

In the lower part of the main body 1 of the image forming apparatus there is provided a cassette pedestal C, in which provided are cassettes 2*c*, 2*d*, 2*e* and 2*f* as in the main body 1, in order to store a large amount of sheets S. For feeding sheets from these cassettes, there are provided pickup rollers similar to those in the main body 1 and a feed path connected to the feed path 17 in the main body 1.

At the sheet discharging side of the cassette pedestal C there is provided a convey path (reversal path) 40 for passing the sheet S, and the cassette pedestal C and the main body 1 of the image forming apparatus are respectively provided with positioning pins (not shown) in the upper part and positioning holes (not shown) in the lower part for mutual alignment in such a manner that the entrance of the convey path 40 at the upper face and the exit of the reversal path at the lower face of the main body 1 of the image forming apparatus mutually match. The convey paths 29, 40 constitute a switch-back path in which the sheet is switched back and reversed. At the upper end portion of the convey path 40 there is formed a tapered portion for facilitating the entry of the sheet.

When a copying operation is started in the main body 1 of the image forming apparatus in the both-face copying mode or in the one-face copying mode, a scanning optical system 7 is driven whereby the image information of an original set on an original table 15 is read by image reading means 8. Based on such image information, a laser scanner 9 emits a laser beam L for forming an electrostatic image (latent image) on the surface of a photosensitive drum 5, and toner is supplied from a developing unit 16 to develop the electrostatic image into a visible toner image.

A sheet S supplied from the cassette 2*b* through a convey path 17 is appropriately positioned by paired registration rollers 4 and is supplied to a gap between the photosensitive drum 5 and a transfer roller (transfer means) 6, wherein the toner image is transferred from the photosensitive drum 5 onto the sheet S. The sheet S bearing the transferred image is conveyed by a conveyor belt 11, and is supplied to a fixing device 12 composed for example of a fixing roller 12*a* and a pressure roller 12*b*, wherein heat and pressure are applied to the sheet S to fix the toner image thereon.

In case of the one-face copying mode, the sheet S bearing the fixed image is discharged by paired inner discharge rollers 21 and paired outer discharge rollers 22 to a sheet discharge tray 20*a*, or through paired rollers 35, 36, 39 to a sheet discharge tray 20*b* or 20*c*.

In case of the both-face copying mode, the sheet S bearing the image on one side thereof is conveyed by the paired inner discharge rollers 21 driven by roller driving means (not shown), then guided by a flapper 23, and passes through the paired convey rollers 24. Then the sheet S is directed downwards by a flapper 26, and passes through a convey path 25 and an elastic sheet 28 composed for example of a resinous material and provided for switching or branching the sheet path. Then the sheet S is fed, by paired forward-reverse rotation rollers 32, into a convey path 29 formed by the inner side of the openable guide 30 and a guide member 29*a* provided in the main body.

In this state, the rear end position of the sheet S is detected by sheet detecting means (not shown), and the sheet S is conveyed by the paired forward-reverse rotation rollers 32, according to the detected signal, until the sheet S passes through the elastic sheet 28. When the sheet S passes through the elastic sheet 28, the paired forward-reverse rotation rollers 32 are reversed to displace the sheet S in the opposite direction into a convey path 27 by the elastic sheet 28, and the sheet S is then conveyed into a convey path 18 by the paired entrance rollers 18*a*, whereby the sheet S is reversed.

If the sheet S is short, the reversing of the sheet is completed while the front end thereof is still in the convey path 29 of the main body 1 of the image forming apparatus, but, if the sheet S is longer, in the reversing operation, the front end thereof goes beyond the convey path 29 and enters the convey path 40 constituting the reversal path in the cassette pedestal C.

For forming an image on the rear side of the reversed sheet S, it is guided through the convey path 18 and then through the convey path 17 as in the image forming operation on the front side, and is positioned by the registration rollers 4. On the other hand, an image is formed on the photosensitive drum 5 in the image forming unit B and is transferred by the transfer roller 6 onto the sheet S, which is conveyed by the conveyor belt 11 to the fixing device 12 for image fixation. Subsequently a flapper 23 in the sheet discharging unit D is shifted by switching means (not shown) to a chain-lined position to form a convey path, whereby the sheet S is discharged by the outer sheet discharging rollers 22 onto the sheet discharge tray 20*a*. The both-face copying is completed in this manner.

The present embodiment will be clarified further in the following with reference to FIGS. 1 to 5. One of the paired forward-reverse rotation rollers 32 is mounted on the openable guide member 30 constituting the reversal path, while the other roller is mounted in the main body of the apparatus. At the lower end of the openable guide member 30, there is provided a rotary hinge 30*a* for enabling rotary movement thereof. An engaging portion 30*b* provided on the openable guide member 30 engages with a hook 33 provided on the sheet discharging unit D.

There are also provided a wire 30*c* provided between the openable guide member 30 and the main body 1 for determining the open angle of the openable guide member 30, a guide roller 31 for guiding the openable guide member 30, a hook 33 engaging with the engaging portion of the openable guide member 30 for opening the same, a spring 34 for providing the hook 32 with a tension, convey rollers 24, 35, 36, 39, and flappers 23, 26, 27 for switching the advancing direction of the sheet S.

There are further provided a reversal path 40 provided substantially vertically in the sheet discharging side of the cassette pedestal and serving to accommodate the sheet to be reversed, a plate-shaped inner vertical guide member 41 provided in the main body of the cassette pedestal and constituting a side of the reversal path, and an outer guide member 42*b* constituting the other side of the reversal path and composed of plural guide ribs integrally formed with the external cover 42. The lower end of the inner vertical guide member 41 is connected, through a curved portion 41*a*, to an inclined guide portion 41*b*. Also at the lower part of the outer guide member 42*b* there is formed a curved portion corresponding to the above-mentioned curved portion, whereby the lower part of the reversal path 40 constitutes an inclined path (discharge path) smoothly curving downwards toward the outside, thereby ensuring smooth movement of the sheet to the exterior of the cassette pedestal.

A slit-shaped aperture 42*a* formed in a part of the external cover 42, preferably in the lower part thereof, has a width larger than the maximum width of the sheet. A guide member 42*c* for guiding the sheet from the lower part of the inclined guide 41*b* to the aperture 42*a* is integrally formed with the external cover 42 and constitutes, together with the guide 41, a guide path.

Figure 4:
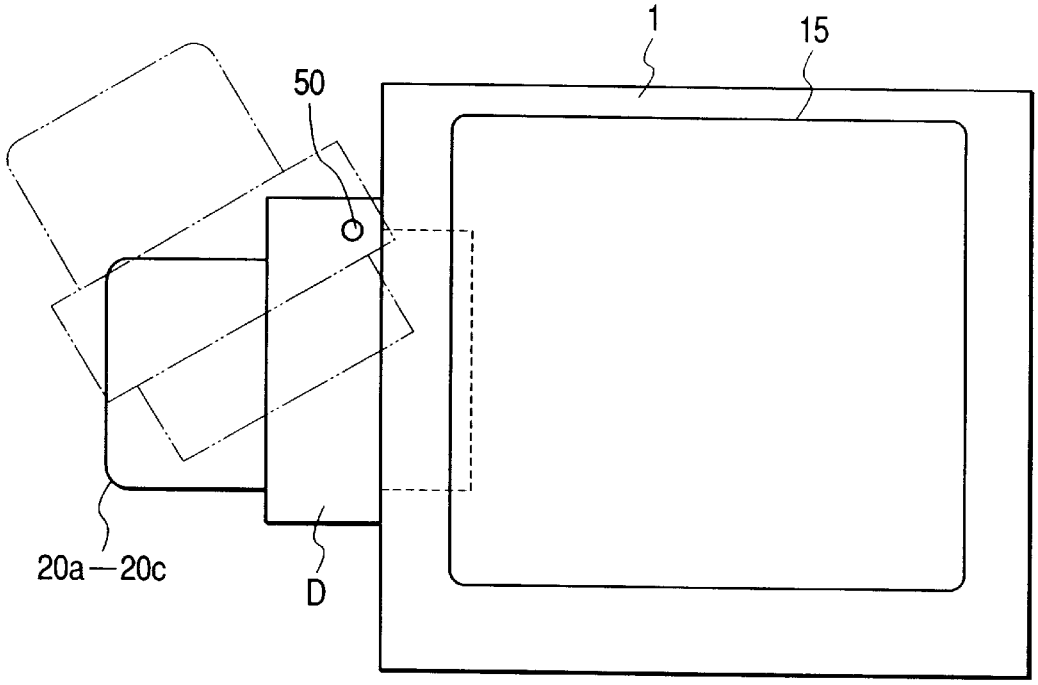
FIG. 4 is a plan view showing the relationship between the rotary axis of the multiple sheet discharging tray unit and the main body of the apparatus in the above-mentioned embodiment.
Figure 5:
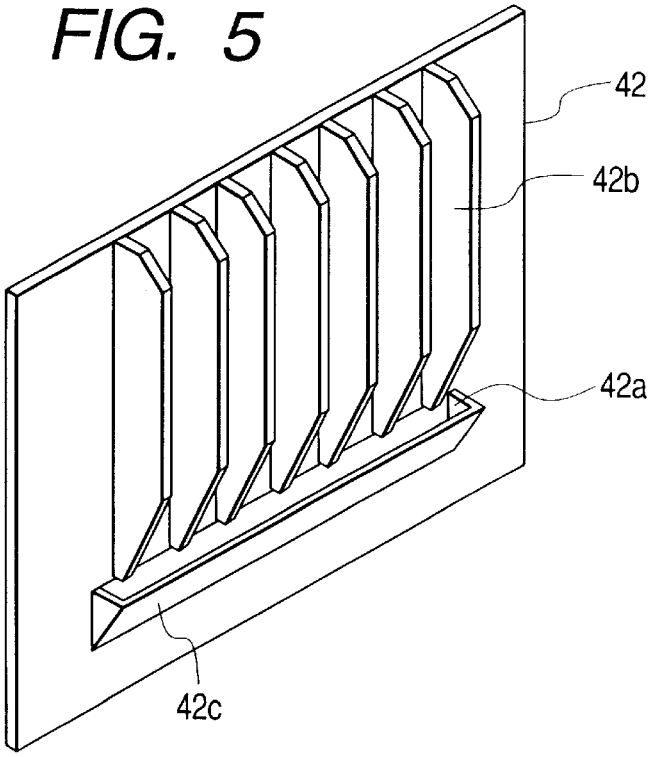
FIG. 5 is a perspective view of an external cover of a multi-tray sheet feeding unit in the above-mentioned embodiment.
Figure 6:
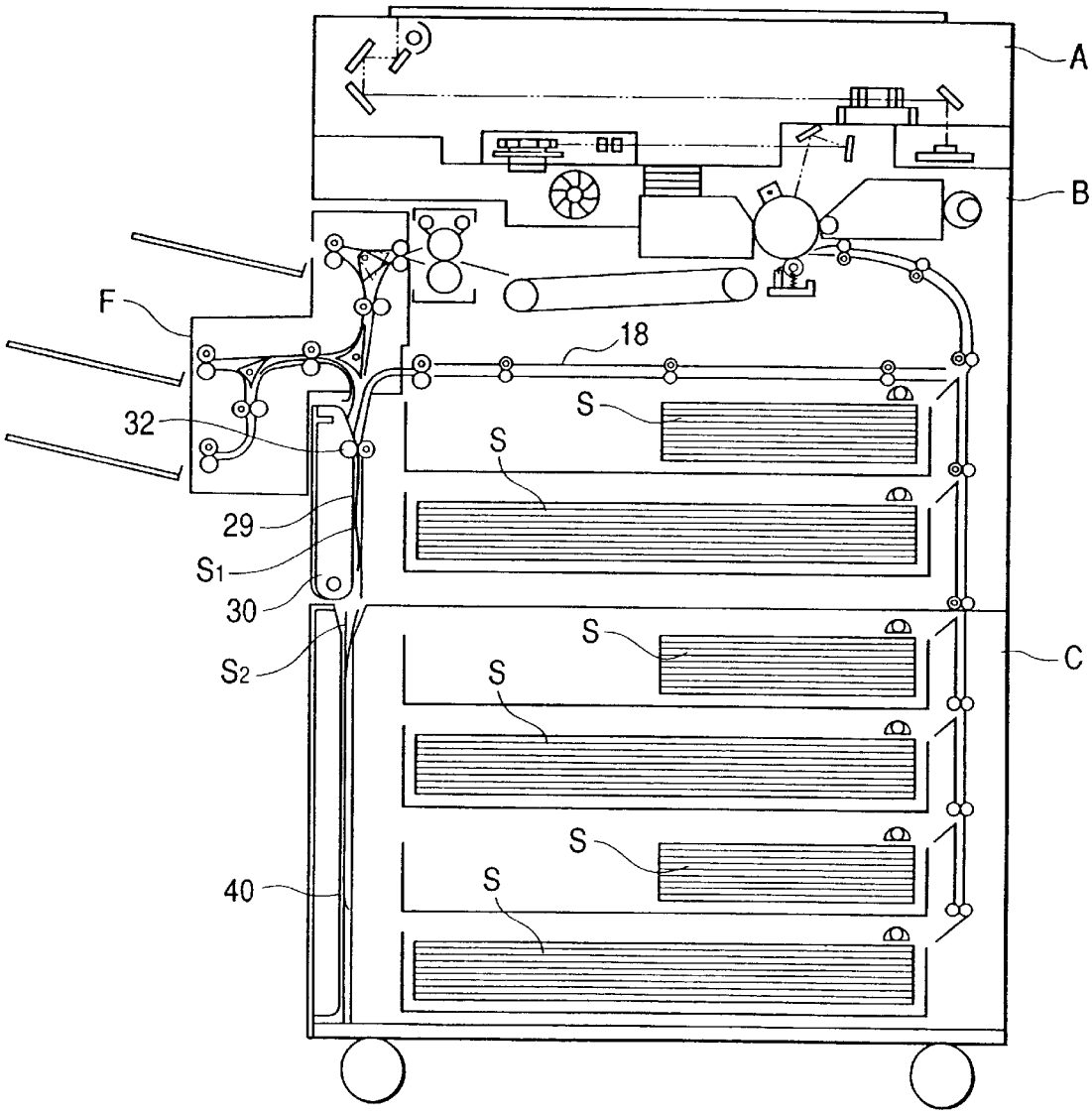
FIG. 6 PRIOR ART
FIG. 6 is a schematic cross-sectional view showing a conventional image forming apparatus.

As shown in FIG. 4, the multiple sheet discharging trays D have a vertical rotary axis, so that the trays D can be rotated, in disposing of the jammed sheet, from a solid-lined operable position to a chain-lined open position.

In the following there will be explained the dropping of the remaining sheet from the forward-reverse rollers 32.

1) Reversal Sheet Discharge Mode with One Bin

In case of discharging A3 or A4-sized sheet with reversal to the first bin (tray) 20*a*, the sheet passing through the fixing unit 12 and conveyed by the inner sheet discharging rollers 21 is guided, by the flapper 23 in the broken-lined position, to the convey rollers 24. When the rear end of the sheet conveyed by the convey rollers 24 passes through the flapper 23, the convey rollers 24 start to rotate in the opposite direction whereby the sheet is switched back. The sheet advancing in the opposite direction is guided by the flapper 23 and the outer sheet discharging rollers 22 and is discharged onto the first bin 20*a*.

In this operation, the sheet is switched back without passing the convey rollers 24 to the downstream side thereof. If a jam (abnormality in conveyance) is caused somewhere in the image forming apparatus, a control circuit (control means, not shown) stops the convey rollers 24. After the conveyance is interrupted, the sheet is held between the convey rollers 24.

The jammed sheet disposal is achieved by opening the openable guide member 30, but, in this operation, the sheet is still held by the convey rollers 24 and does not drop.

2) Reversal Sheet Discharge Mode with Two or Three Bins

In case of discharging a sheet with reversal to the second bin 20*b* or the third bin 20*c*, the sheet after image fixation is guided by the flapper 23, then conveyed by the convey rollers 24 and guided by the flapper 26 to the reversing rollers 32. When the rear end of the sheet passes through the flapper 26, the reversing rollers 32 start to rotate in the opposite direction whereby the sheet is guided by the flapper 26 to the convey rollers 35. The flapper 37 switches the advancing direction of the sheet either to the second bin 20*b* through the discharge rollers 36 or to the third bin 20*c* through the discharge rollers 39.

In case the conveyance is interrupted by a sheet jam, the rollers 32*a*, 32*b* of the paired rollers 32 are mutually separated by the opening of the openable guide member 29, so that the sheet held only by the paired convey rollers 32 during the switch-back operation drops along the reversal path 40 and is discharged to the exterior through the aperture 42*a*.

3) Both-face Mode

In the both-face mode, the sheet bearing an image on the first face is sent again to the photosensitive drum 5 and the transfer roller 6 for forming another image on the second side. In the both-face mode, the sheet after the image fixation is guided by the flapper 23 to the paired convey rollers 24 and is further guided by the flapper 26. When the rear end of the sheet conveyed downward by the reversing rotation rollers 32 passes through the elastic sheet 28, the reversing rotation rollers 32 start to rotate in the opposite direction, whereby the sheet is guided by the elastic sheet 28 to the convey path 27 and is further conveyed by the convey rollers 18*a*, 18*b*, 18*c* and 18*d*.

In case the conveyance is interrupted by a sheet jam, the rotation rollers 32*a*, 32*b* of the paired rotation rollers 32 are mutually separated by the opening of the openable guide member 29, so that the sheet held only by the paired convey rotation rollers 32 during the switch-back operation drops along the reversal path 40 and is discharged to the exterior through the aperture 42*a*.

As the lower part of the reversal path 40 forms a guide path constituted by the curved portion 41*a*, inclined guide 42*c* and guide ribs 42*b* and leading to the exterior of the cassette pedestal C, the sheet S drops without stopping and is discharged to the exterior. As the curved portion 41*a* of the guide path 40 is formed in a rounded shape, the frond end of the sheet S, even if curled oppositely to the guide path, is not stopped so that the sheet S can be discharged to the exterior of the cassette pedestal.

According to the present invention, as explained in the foregoing, even if the sheet drops into the reversal path in case of disposing of the sheet jammed in the openable guide member of the image forming apparatus, such dropping sheet does not remain in the reversal path but is smoothly discharged to the exterior of the sheet feeding unit, so that cumbersome operation of removing the jammed sheet can be dispensed with.

Also, since the sheet dropping into the reversal path does not remain therein, the reversing operation for the ensuing sheet is not hindered by the preceding sheet remaining in the reversal path whereby the sheet jamming can be prevented. Furthermore, there can be dispensed with the sheet sensor for detecting the sheet remaining in the reversal path or the means for opening the external cover for removing the dropped sheet, whereby the configuration of the apparatus can be simplified.

What is claimed is:

1. An image forming apparatus provided with at least a sheet stacking means for stacking sheets for image formation, an external cover surrounding the perimeter of said sheet stacking means, and a substantially vertical reversal path positioned at a side of said sheet stacking means and serving to reverse the sheet, said image forming apparatus comprising:

a slit-shaped aperture formed in a substantially horizontal direction in said external cover, and an inclined path connecting said slit-shaped aperture and the lower part of said reversal path, wherein the sheet is reversed in said reversal path without reaching said slit-shaped aperture, and a sheet dropped from said reversal path by a self-weight of the sheet is passed through said inclined path to be discharged outside of said image forming apparatus from said slit-shaped aperture.

2. An image forming apparatus according to claim 1, wherein said reversal path and said inclined path are constituted by an outer guide formed on said external cover and an inner guide positioned in the main body of a sheet feeding unit and opposed to said outer guide with a gap.

3. An image forming apparatus according to claim 2, wherein said outer guide is constituted by plural ribs provided on said external cover and extending substantially vertically.

4. An image forming apparatus as in claim 2 or 3, wherein said inner guide is constituted by a vertical guide portion formed substantially vertically in the main body of the sheet feeding unit, an inclined guide portion connected to the lower end of said vertical guide portion, and a guide portion for guiding the sheet from said inclined guide portion to said slit-shaped aperture.

5. An image forming apparatus as in claim 2 or 3, wherein the vertical guide portion and the inclined guide portion of said inner guide are connected by a curved portion.

6. An image forming apparatus as in claim 2 or 3, wherein said inner guide is constituted by a plate-shaped member.

7. An image forming apparatus as in claim 1, 2, or 3, wherein the upper end of said reversal path has a funnel-shaped tapered cross section.

8. An image forming apparatus as in claim 1, 2, or 3, wherein a feed path for feeding the sheet to image forming means is provided at one side of said sheet stacking means, and said reversal path for receiving the sheet bearing, on one face thereof an image formed by the image forming means, is provided at the other side of said sheet stacking means.

9. A sheet conveying apparatus comprising:

a pair of rollers for pinching and conveying a sheet along a conveying path which is downwardly extended; and guide for defining at least a part of said conveying path and movable for opening said conveying path, wherein said pair of rollers are separated from each other when said guide is moved to open said conveying path, and a discharge path is provided below said conveying path, said discharge path through which the sheet is discharged outside said sheet conveying apparatus from a discharge aperture, and wherein, only when the sheet pinched by said pair of rollers is dropped by a separation of said pair of rollers, the sheet can reach said discharge aperture.

10. A sheet conveying apparatus according to claim 9, wherein said pair of rollers switch back the sheet introduced into said conveying path.

11. A sheet conveying apparatus according to claim 9, wherein said guide is formed integrally with an external cover of said apparatus.

12. A sheet conveying apparatus according to claim 11, wherein a part of said discharge path is formed on said external cover, and a discharge aperture of said discharge path is formed on said external cover.

13. A sheet conveying apparatus according to claim 11, wherein an accessory device is connected separably from said apparatus, at a side area thereof and in a position covering at least a part of said external cover.

14. A sheet conveying apparatus according to claim 13, wherein said accessory device includes a tray for stacking sheets to be discharged from the apparatus through a discharge path different from said discharge path.

15. A sheet conveying apparatus according to claim 9, wherein said discharge path discharges the sheet by free fall thereof.

16. A sheet conveying apparatus according to claim 9, further comprising control means for stopping a conveyance of the sheet by said pair of rollers in case of an abnormality in the conveyance of the sheet.

17. An image forming apparatus comprising:

a pair of rollers for pinching and conveying a sheet along a conveying path which is downwardly extended;

guide for defining at least a part of said conveying path and movable for opening said conveying path, wherein said pair of rollers are separated from each other when said guide is moved to open said conveying path, and a discharge path is provided below said conveying path, said discharge path through which the sheet is discharged outside said image forming apparatus from a discharge aperture, and wherein, only when the sheet pinched by said pair of rollers is dropped by a separation of said pair of rollers, the sheet can reach said discharge aperture; and image forming means for forming an image on the sheet.

18. A sheet conveying apparatus comprising:

a pair of rollers for pinching and conveying a sheet along a conveying path which is downwardly extended;

separation means for separating said pair of rollers; and a discharge path through which the sheet is discharged outside said sheet conveying apparatus from a discharge aperture, said discharge path communicating with a lower portion of said conveying path, wherein, only when the sheet pinched by said pair of rollers is dropped by said separation means separating said pair of rollers, the sheet can reach said discharge aperture.

19. An image forming apparatus comprising:

a pair of rollers for pinching and conveying a sheet along a conveying path which is downwardly extended;

separation means for separating said pair of rollers; and a discharge path through which the sheet is discharged outside said image forming apparatus from a discharge aperture, said discharge path communicating with a lower portion of said conveying path, wherein, only when the sheet pinched by said pair of rollers is dropped by said separation means separating said pair of rollers, the sheet can reach said discharge aperture; and image forming means for forming an image on the sheet.

* * * * *

UNITED STATES PATENT AND TRADEMARK OFFICE

CERTIFICATE OF CORRECTION

PATENT NO. : 6,328,303 B1
DATED : December 11, 2001
INVENTOR(S) : Masami Maetani It is certified that error appears in the above-identified patent and that said Letters Patent is hereby corrected as shown below:

Title page,
Item [56] References Cited, FOREIGN PATENT DOCUMENTS, "40-5208737", "40-6127793", "40-6156774", and "40-6183609" should read -- 5-208737 --, -- 6-127793 --, -- 6-156774 --, and -- 6-183609 --, respectively.

Column 1,
Line 19, "once" should read -- first --.

Column 6,
Line 65, "guide" should read -- a guide --.

Column 7,
Line 38, "guide" should read -- a guide --.

Signed and Sealed this

Sixteenth Day of April, 2002

*Attest:*

*Attesting Officer*

JAMES E. ROGAN
*Director of the United States Patent and Trademark Office*